United States Patent [19]

Spinks, Jr. et al.

[11] Patent Number: 4,496,953

[45] Date of Patent: Jan. 29, 1985

[54] BROADBAND VERTICAL DIPOLE ANTENNA

[75] Inventors: Raleigh J. Spinks, Jr., Marion; Richard C. Edwards; Joseph J. Dahm, both of Cedar Rapids, all of Iowa

[73] Assignee: Rockwell International Corporation, El Segundo, Calif.

[21] Appl. No.: 401,474

[22] Filed: Jul. 26, 1982

[51] Int. Cl.[3] ..... H01Q 9/16

[52] U.S. Cl. ..... 343/792; 343/822

[58] Field of Search ..... 343/792, 793, 787

[56] References Cited

U.S. PATENT DOCUMENTS

| | | | |
|---|---|---|---|
| 3,100,893 | 8/1963 | Brueckmann | 343/792 |
| 3,438,042 | 4/1969 | Kuecken | 343/792 |
| 3,534,371 | 10/1970 | Seavey | 343/792 |
| 3,680,146 | 7/1972 | Leitner et al. | 343/792 |
| 4,028,704 | 6/1977 | Blass | 343/715 |
| 4,201,989 | 5/1980 | Czerwinski | 343/715 |
| 4,330,783 | 5/1982 | Toia | 343/792 |
| 4,352,109 | 9/1982 | Reynolds et al. | 343/792 |
| 4,359,743 | 11/1982 | De Santis | 343/792 |

*Primary Examiner*—Eli Lieberman
*Assistant Examiner*—Karl Ohralik
*Attorney, Agent, or Firm*—Richard K. Robinson; George A. Montanye; H. Fredrick Hamann

[57] ABSTRACT

An antenna for operating over a broadband of frequencies includes an operating radiating elements for radiating radio frequency energy at a selected band of frequencies and a lower radiating element for providing a counter poise to the upper radiating element. An antenna coupler transforms the load impedance of the upper radiating elements and the lower radiating element to a nominal impedance, such as 50 ohms. The coupler element also electronically couples the lower radiating element to the upper radiating element.

5 Claims, 4 Drawing Figures

BROADBAND VERTICAL DIPOLE ANTENNA

BACKGROUND OF THE INVENTION

The Government has rights in this invention pursuant to Contract No. DAAB07-78-C-0160 awarded by the Department of the Army.

This invention relates to broadband antennas and, in particular, to mobile mounted broadband antennas.

Communications between movable objects, such as tactical vehicles or soldiers operating in the field, has long presented problems for VHF communications over broadbands. One example of a prior art vehicular antenna for VHF communications is a 10 foot long whip antenna and is broadband only in the sense that it has 10 frequency sub-bands in the range of 30 through 76 MHz. The switching time from one band to another is an undesirable feature of this antenna, especially when applied to a secured transmission system that utilizes frequency hopping techniques.

SUMMARY OF THE INVENTION

An antenna for operating over a broadband of frequencies includes an upper radiating element for radiating radio frequency energy at a selected band of frequencies and a lower radiating element for providing a counter poise to the upper radiating element. An antenna coupler transforms the load impedance of the upper radiating element and the lower radiating element to a nominal impedance, such as 50 ohms. The antenna coupler also electronically couples the lower radiating element to the upper radiating element.

The radio frequency energy is transmitted to the antenna coupler by a coaxial transmission line after first passing through a choke that prevents transmission of unbalanced currents to the antenna coupler. The lower radiating element is a tubular element with an inside diameter large enough for the coaxial transmission line to pass. The transmission line is held in place and isolated from the walls of the tubular member by a plurality of ferrite sleeves that are equally spaced within the tubular member from which the lower radiating element is achieved.

It is the object of this invention to provide a antenna that may be operated without ground plane considerations.

It is another object of the invention to provide one embodiment of the antenna that will operate over the frequency band of 30 to 88 MHz while maintaining a VSWR less than or equal to 3.5:1.

It is yet another object of the invention to provide a broadband antenna that has input impedance matching over the range of 30 to 88 MHz without requiring tuning at each frequency change.

It is yet another object of the invention to provide an antenna that may be operated with spread spectrum radios, multiplexers or band switching systems.

BRIEF DESCRIPTION OF THE DRAWINGS

In order that the invention may be readily carried into practice, a number of embodiments will now be described in detail by way of example, with reference to the accompanying drawings in which.

DETAILED DESCRIPTION OF THE PREFERRED EMBODIMENTS

Figure 1:
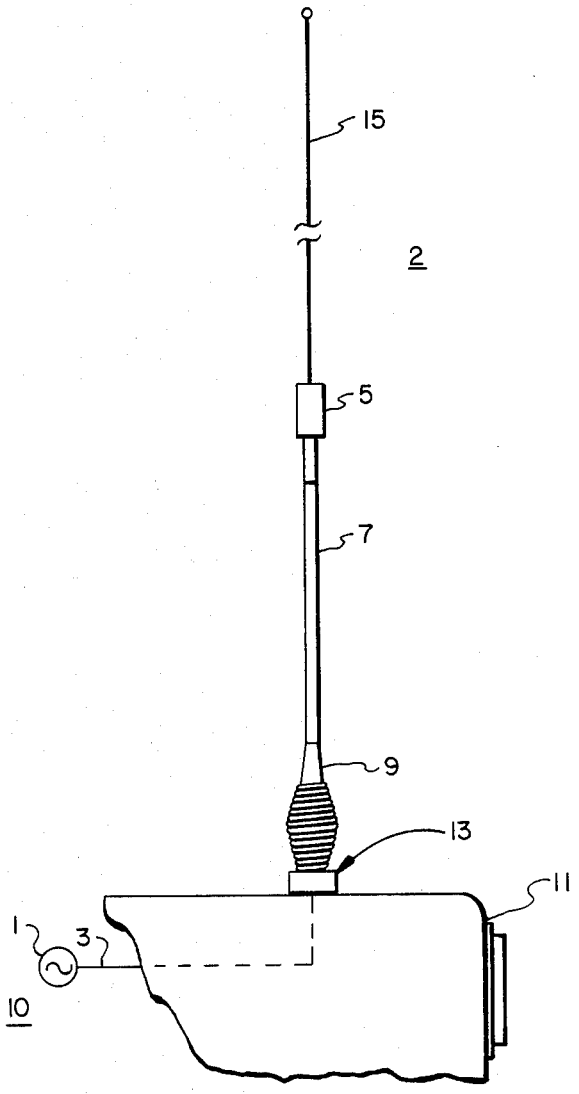
FIG. 1 is a mechanical drawing of a vehicular mounted antenna according to the invention.

In FIG. 1, to which the reference should now be made, there is shown a vehicular mounted antenna according to the invention. A frequency source 1, such as a radio transmitter, drives the antenna via a coaxial cable 3. The coaxial cable 3 is connected to an antenna coupler that is contained within a coupler housing 5 after passing through a lower radiating element 7 and a choke and isolation circuit 9. The antenna is mounted to a vehicle 11 by the spring and mounting base 13. An upper radiating element 15 is used to transmit radio frequency energy that is provided by the radio signal source 1 in conjunction with the lower radiating element 7 that provides a counterpoise for the upper radiating element 15. The circuit arrangement enables the antenna to operate without ground plane consideration due to the counterpoise.

In the preferred embodiment, for an antenna that operates in a frequency of range of 30 to 88 MHz, the upper radiating element is 70 inches long and the lower radiating element 7 is 30 inches long. The coupler housing 5 and the spring and mounting base 13 together are 18 inches long, providing a total length of approximately 118 inches for the antenna.

Figure 2:
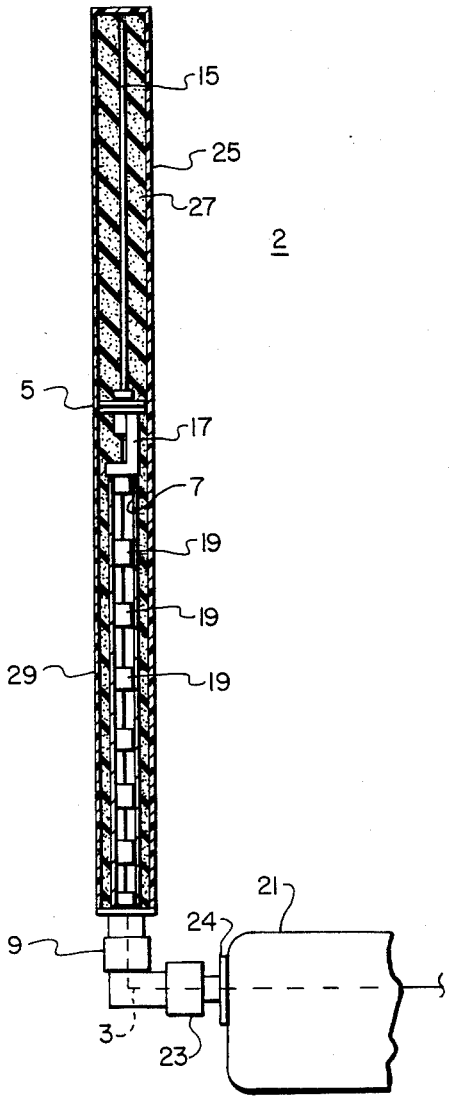
FIG. 2 is a mechanical drawing of a manpack mounted antenna according to the invention.

In FIG. 2, to which reference should now be made, a manpack 21, which is usually carried by a man in the field, contains the radio signal source 1. The coaxial cable 3 couples the radio frequency energy to an antenna coupler 17, which is contained in the antenna coupler housing 5. The antenna 2 is connected to the manpack 21 by a collar 24 which is connected to a choke housing 23 that contains a choke circuit. The upper radiating element 15 and the lower radiating element 7 are contained within the upper housing 25 and the lower housing 29 respectively. The housings in the preferred embodiment are a non metal braid with a silicone protecting coating. Close cell sponges 27 located within the housings are used to support the upper radiating element 15 and the lower radiating element 7 within the upper housing 25 and the lower housing 29. The coaxial cable 3 passes through the choke section 9 to the antenna coupler 17 by passing through the lower radiating element 7. Within the lower radiating element 7 is a plurality of ferrite sleeves 19 which position the coaxial cable in the center of the radiating element 7 while cancelling out unwanted fields which may be generated by the current passing through the coaxial cable 3.

Figure 3:
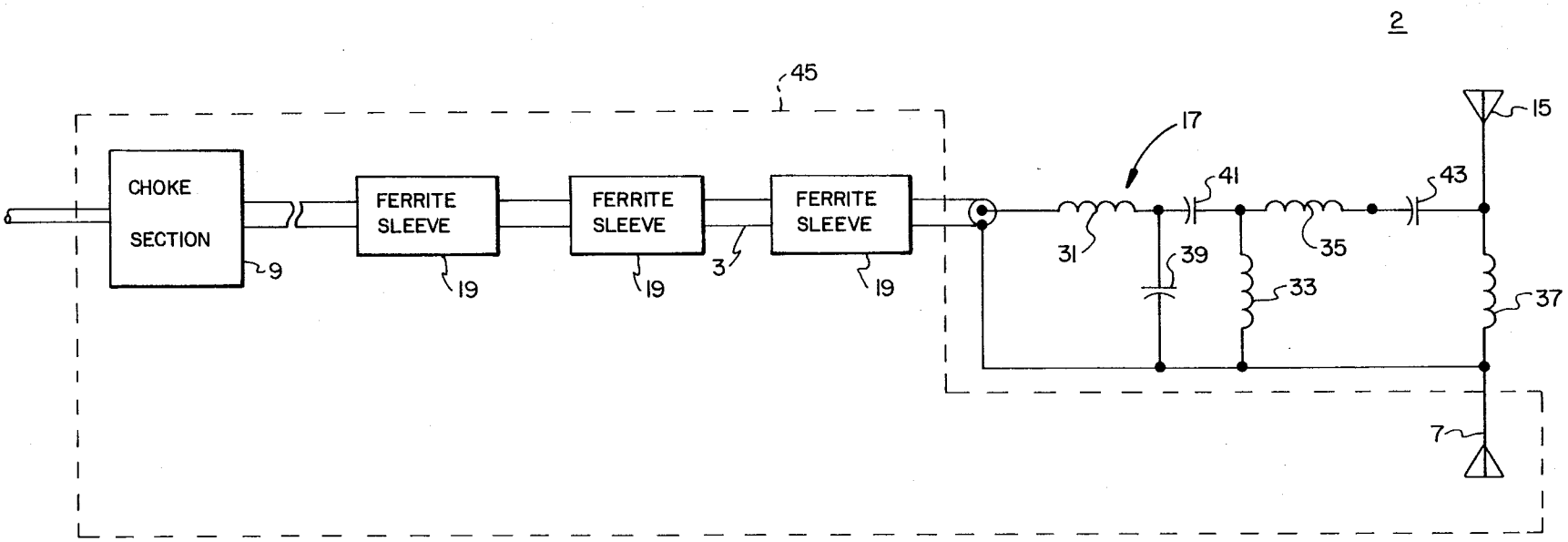
FIG. 3 is a schematic diagram of the antenna according to the invention.

FIG. 3, to which reference should now be made, there is shown a schematic diagram of the antenna 2 which includes the upper radiating element 15 and the lower radiating element 7. The antenna coupler 17 connects the upper radiating element 15 to the lower radiating element 7. The antenna coupler 17 includes an LC network that includes inductors 31, 33, 35 and 37 and capacitors 39, 41 and 43. The selection of the inductors and capacitors used in the coupler 17 in the preferred embodiment are such to insure operation of the antenna over 30 to 88 MHz with an impedance match of 50 ohms. There is a counter poise 45 which is used to cancel out downward radiated energy from the upper radiating element 15. The counter poise 45 includes the lower radiating element 7 as well as the choke section 9 and a plurality of equally spaced ferrite sleeves 19 through which the coaxial cable 3 passes. The number of ferrite sleeves 19 is selected to provide optimum isolation without the antenna becoming too lossy. The choke section 9, in the preferred embodiment, is made from passing a conductor through ferrite sleeves and is held to the same design constraints as the selection of the number of ferrite sleeves discussed above.

Figure 4:
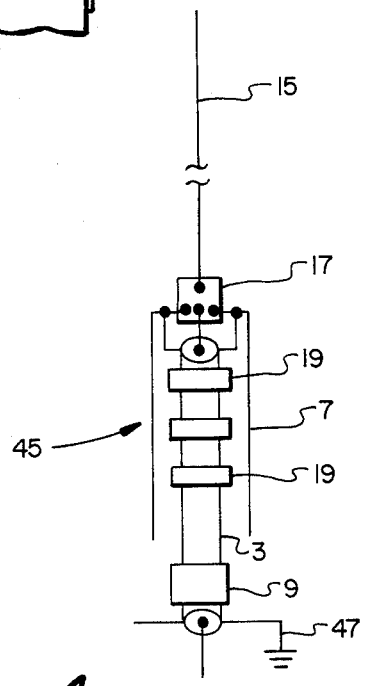
FIG. 4 is a mechanical diagram of the antenna according to the invention.

The physical arrangement of the counter poise 45 includes a hollow tube for the lower radiating element 7. The ferrite sleeves 19 as well as the transmission line 3 are mounted within the hollow tube. This embodiment is detailed more fully in FIG. 4 to which reference should now be made.

The counter poise 45 is shown as the lower radiating element 7, which is a tubular member, through which the coaxial cable 3 passes. A plurality of ferrite sleeves 19 maintain the coaxial cable 3 in the center of the lower radiating element 7 while providing isolation through the cancellation of undesirable energy produced by the current flow through the coaxial cable 3. Further cancellation is provided by the choke section 9 which causes cancellation of undesirable electromagnetic fields. These fields are produced by current flow that is induced on the coaxial cable by the antenna elements and, consequently, the choke section 9 is used to eliminate these currents. The choke section 9 is selected to offer a high impedance to the unbalanced currents on the transmission lines yet allow easy passage of the desired currents. The ferrite sleeves 19 operate in a similar manner as the choke section 9.

Many changes and modifications in the above described invention can, of course, be carried out without departing from the scope thereof. Accordingly, the invention is intended to be limited only by the scope of the appended claims.

We claim:

1. An antenna system for providing mounting independent operation comprising:

an antenna section including a first electrical conductor extending along an axis and forming a radiating element for radiating radio frequency energy over a selected band of frequencies, and a second electrical conductor forming a radiating element and constructed as an electrically conductive tubular member defining a counterpoise ground plane for said first electrical conductor, said second electrical conductor being coaxial to said axis and said first and second electrical conductors each having one end coupled to one another such that said first and second electrical conductors are supported in a collinear configuration;

a transmission line having first and second ends and a characteristic impedance of substantially 50 ohms;

an antenna coupler forming an impedance matching network electrically coupled to said first end of said transmission line and to said one end of said first and second electrical conductors to impedance match said antenna section at a nominal 50 ohms;

a plurality of ferrite cores disposed within said conductive tubular member and surrounding said transmission line, said ferrite cores being spaced from one another along the length of said transmission line within said conductive tubular member;

a mounting base; and means for coupling said conductive tubular means to said mounting base to support said antenna section with respect to said mounting base, said transmission line extending through said means for coupling such that said second end of said transmission line extends to said mounting base, said means for coupling further including a choke coupled between said mounting base and said antenna section to choke electromagnetic energy induced in said transmission line from said mounting structure and antenna section.

2. The antenna system of claim 1 wherein said transmission line is a coaxial cable having an inner conductor coupled through said coupler to said one end of said first electrical conductor and an outer conductor coupled to said one end of said second electrical conductor.

3. The antenna system of claim 2 wherein said coupler is an L-C network.

4. The system of claim 3 wherein said L-C network is selected to provide broadband operation by impedance matching to a nominal 50 ohms over a frequency range of 30–88 MHz.

5. The system of claim 1 wherein said antenna section includes a housing surrounding said first and second electrical conductors to form a protective enclosure.

* * * * *